US005690373A

United States Patent [19]

Luker

[11] Patent Number: 5,690,373

[45] Date of Patent: Nov. 25, 1997

[54] ELECTROMAGNETIC LOCK

[75] Inventor: Graham James Luker, Sydney, Australia

[73] Assignee: Trimec Securities Pty. Limited, Australia

[21] Appl. No.: 537,881

[22] PCT Filed: Nov. 8, 1994

[86] PCT No.: PCT/AU94/00684

§ 371 Date: Jan. 22, 1996

§ 102(e) Date: Jan. 22, 1996

[87] PCT Pub. No.: WO95/23269

PCT Pub. Date: Aug. 31, 1995

[30] Foreign Application Priority Data

Feb. 25, 1994 [AU] Australia ..... PM4090

[51] Int. Cl.[6] ..... E05C 3/06

[52] U.S. Cl. ..... 292/201; 292/210; 292/144

[58] Field of Search ..... 292/201, 143, 292/141, 144, 341.15, 341.16, 210

[56] References Cited

U.S. PATENT DOCUMENTS

| | | | |
|---|---|---|---|
| 2,228,674 | 1/1941 | Raymond | 292/410 X |
| 4,573,333 | 3/1986 | Choi | 292/210 X |
| 4,616,865 | 10/1986 | Mackle | 292/341.16 |
| 4,648,253 | 3/1987 | Imhoff | 292/210 X |
| 4,776,619 | 10/1988 | Daugherty et al. | 292/210 X |
| 4,917,425 | 4/1990 | Logas | 292/341.16 |
| 5,029,912 | 7/1991 | Gotanda | 292/143 |
| 5,118,150 | 6/1992 | Jarrett | 292/341.6 |
| 5,127,691 | 7/1992 | Herron et al. | 292/144 X |
| 5,195,792 | 3/1993 | Strendall | 292/341.16 |
| 5,199,288 | 4/1993 | Merilainen | 292/144 X |

*Primary Examiner*—Rodney M. Lindsey
*Assistant Examiner*—Monica E. Millner
*Attorney, Agent, or Firm*—Jacobson & Johnson

[57] ABSTRACT

There is a lock for a door or the like which comprises a tongue pivotable on an axis between a locking position where it engages a striker and an unlocked position where it is clear of the striker. A pawl is pivotable on a second axis between a first position where one end abuts said tongue to hold it in said locking position and a second position where said one end is clear of the tongue. There is a set of toggles hingedly connected end to end between another opposite end of the pawl and another axis. The interconnected ends of the toggles are connected to a solenoid plunger by a link. There is a stop pin which is movable between a fail safe position where when the solenoid is deactivated the toggles are biased by a coil spring against the stop pin in a substantially straight configuration and a fail safe position where during energization of the solenoid the toggles are held to a slightly offset position against the stop pin.

10 Claims, 3 Drawing Sheets

ELECTROMAGNETIC LOCK

This invention relates to locks and more particularly to electromechanical locks.

Existing electromechanical locks typically comprise an electromagnet device which is attached to the inside of a door frame at a position where it contacts a fixed steel plate adjacent the outer edge of a hinged door. So long as power is applied to the electromagnet the door is secured or locked in its closed position. When power is removed the door is free to open. However, as well as being bulky and unsightly such locks have a number of operational disadvantages. The attraction force between the plate and magnet can be weakened (and thus the security of the door compromised) by faulty alignment of the plate or foreign matter such as dirt or oxides accumulating between the magnet and plate. Moreover such locks are restricted to fail safe operation and cannot be operated in the fail secure mode.

It is therefore an object of this invention to ameliorate the aforementioned disadvantages. Accordingly, this invention discloses a lock for a movable barrier such as a door or the like, said lock comprising a tongue pivotable on a first axis between a locking position where it engages a strike and an unlocked position where it is clear of said striker, a pawl pivotable intermediate its ends on a second axis between a first position where one end thereof abuts said tongue to hold it in said locking position and a second position where said one end is clear of the tongue and a set of toggles hingedly connected end to end between the other opposite end of the pawl and a third axis, the interconnected ends of said toggles being linked to a spring biased solenoid plunger and stop means movable between a fail secure position where, upon cessation of current through the solenoid, said toggles are aligned against said stop means in a substantially straight configuration to hold the pawl and tongue in said locking position and a fail safe position where, upon cessation of current through said solenoid, said toggles are offset to a release configuration against said stop means and said pawl and tongue being arranged to then pivot to said unlocked position upon a withdrawal force being applied to the striker.

Preferably said pawl and tongue are shaped so that the direction of force exerted therebetween forms a moment about said second axis which biases the pawl to said second position.

It is further preferred that the striker is deflectable on its mounting plate to one side against a spring bias so as to enable said striker to engage around the tongue while said tongue is stationary.

The currently preferred form of this invention will now be described with reference to the attached drawings in which.

Figure 2:
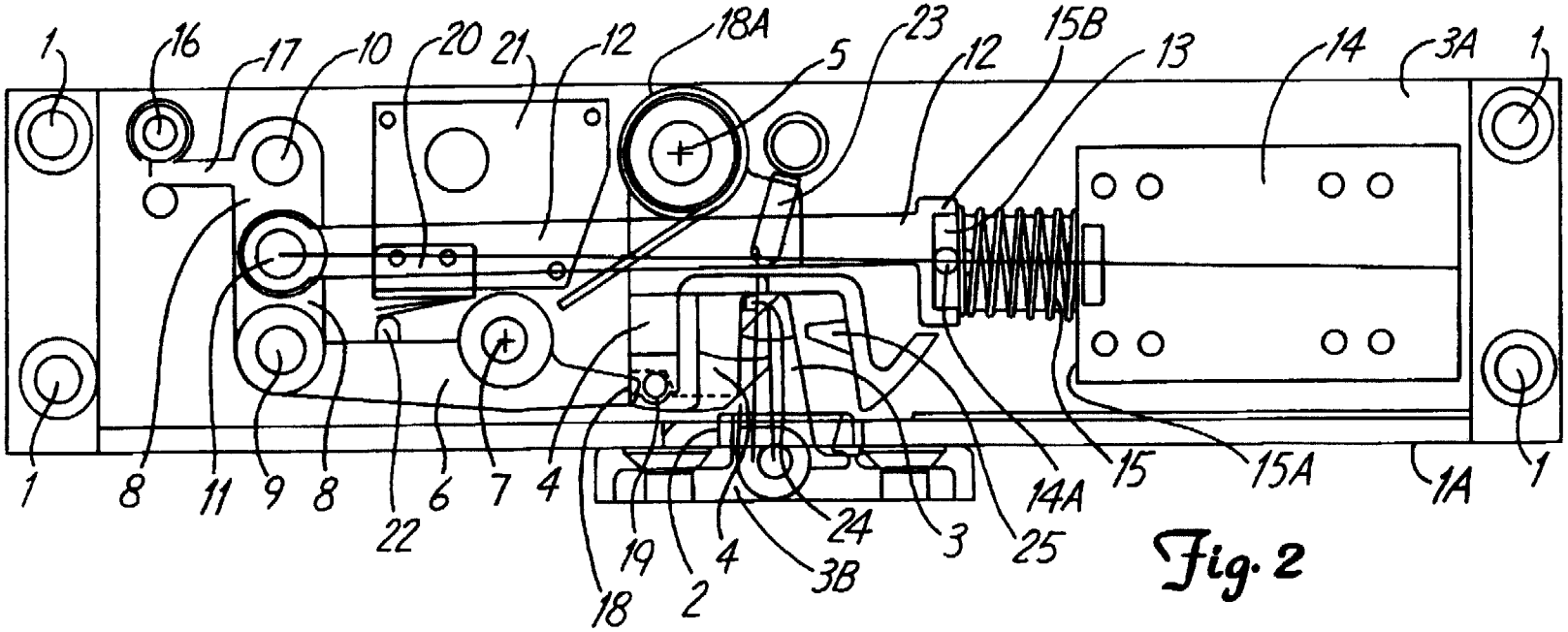
FIG. 2 is a schematic cross-sectional view along the line A—A in the fail secure mode.
Figure 3:
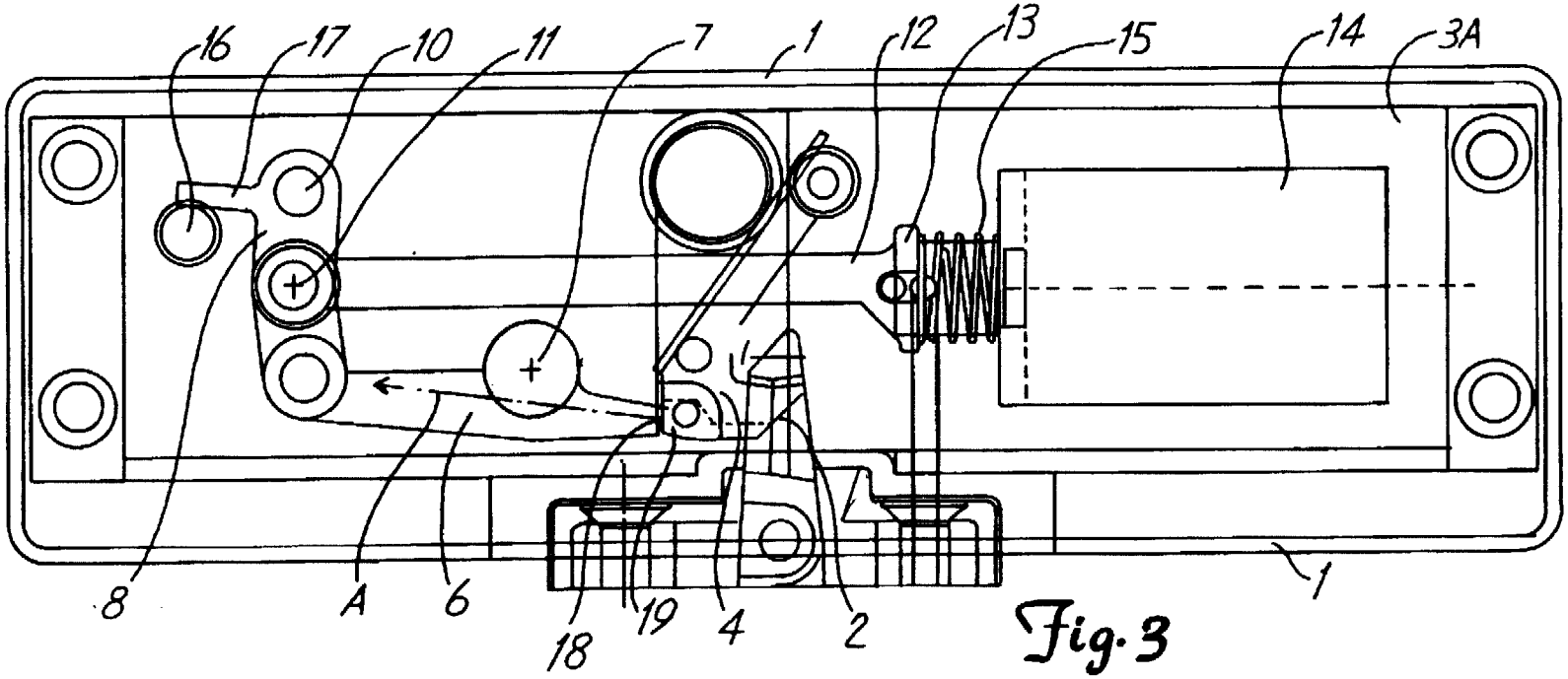
FIG. 3 is a schematic cross-sectional view along the line A—A in the fail safe mode.

The lock exterior may be fabricated from mild steel and be shaped to form an elongated one piece three sided housing which in use may be attached to the inside of a door frame (not shown) using screw holes 1. It may comprise a front face 1A having an aperture 2 into which a door mounted striker 3 enters, a lower wall 3A and an upper wall 3B which has been cut away and is thus not shown on the cross-sectionel views. Referring more specifically to FIGS. 2 and 3 there is shown inside the housing a hook shaped tongue 4 (in the locked position engaging the striker) which is pivotally mounted on a fixed axis 5, an elongated pawl 6 pivotally mounted on a fixed axis 7 and a set of toggles 8 mounted between one end 9 of the pawl and a fixed axis 10. These fixed axes 5, 7 and 10 extend between aligned apertures in the upper and lower walls of the lock housing. The toggles are coupled in series by a hinge 11 which is also connected by a link 12 to the spring biased plunger 13 of solenoid 14 secured to the upper wall of the housing. Preferably the link 12 sits within a diametrical groove across the end of the plunger and is held in place by a transverse pin 14A. A coil compression spring 15 is fitted around the plunger at this point and acts between the front plate 15A of the solenoid which is fixed to the lock housing and a shoulder 15B of the link 12. This spring serves to bias the plunger 13 and link 13 away from the solenoid. In the fail secure mode shown in FIG. 2 with the solenoid deactivated this coil spring 15 is slightly compressed so that the plunger 13, link 12 and the hinge 11 are all biased to the left side of the lock as illustrated. A stop pin 16 is located between the upper and lower walls of the housing at a position where it abuts a lug means 17 on the toggle assembly and holds it in a substantially straight configuration between the fixed axis 10 and the end 9 of the pawl. The other end 18 of the pawl abuts the free end 19 of the tongue 4 and holds it in the locking position shown. In this fail secure mode the door would thus be held closed when the solenoid is deactivated. Moreover by virture of the mechanical advantage obtained from the interaction of the toggles and the shape of the pawl only a relatively light spring pressure is needed to maintain them in the locking relationship shown against a large opening force applied to the striker.

Energising the solenoid 14 draws the plunger 13, link 12 and toggle hinge 11 to the right. This in turn pulls the end 9 of the pawl upwards so that the other end 18 moves clear of the tongue and allows it to pivot to the left against a spring bias 18A as the striker 3 is pulled free.

To obtain fail safe operation the positions of the stop pin 16 and solenoid 14 are changed to those shown in FIG. 3. More specifically the solenoid is relocated slightly to the left so that it is closer to the toggles and the stop pin 16 is moved to a position below the toggle lug 17. In this configuration the solenoid when energised pulls the plunger, link 12 and toggle hinge 11 to the right so that the lug 17 abuts the upper side of the stop pin. This pin 16 is now located so that the toggle assembly preferably is held at an angle of about 10 degrees off straight. This however still has the effect of applying a large mechanical advantage to maintain the pawl in the position shown with its end 18 against the tongue to hold it in the locking position. By increasing the diameter of the stop pin 16 the offset angle of the toggles can be increased. This has the effect of reducing the aforementioned mechanical advantage so that a predetermined withdrawal force on the striker will release the lock notwithstanding the action of the energised solenoid. Deactivating the solenoid however allows the compressed coil spring 15 to bias the mechanism to the unlocked configuration by urging the link 12 to the left and the toggles into a folded posture. The release of the striker in this fail safe mode however is largely facilitated by the novel shape of the pawl 6 which places the line of force A acting on the pawl from the tongue 4 along a direction slightly offset from the axis 7. This creates a moment which further urges the pawl 6 to rotate clock-wise as shown so that its end 18 clears the tongue and allows release of the striker 2.

Figure 1:
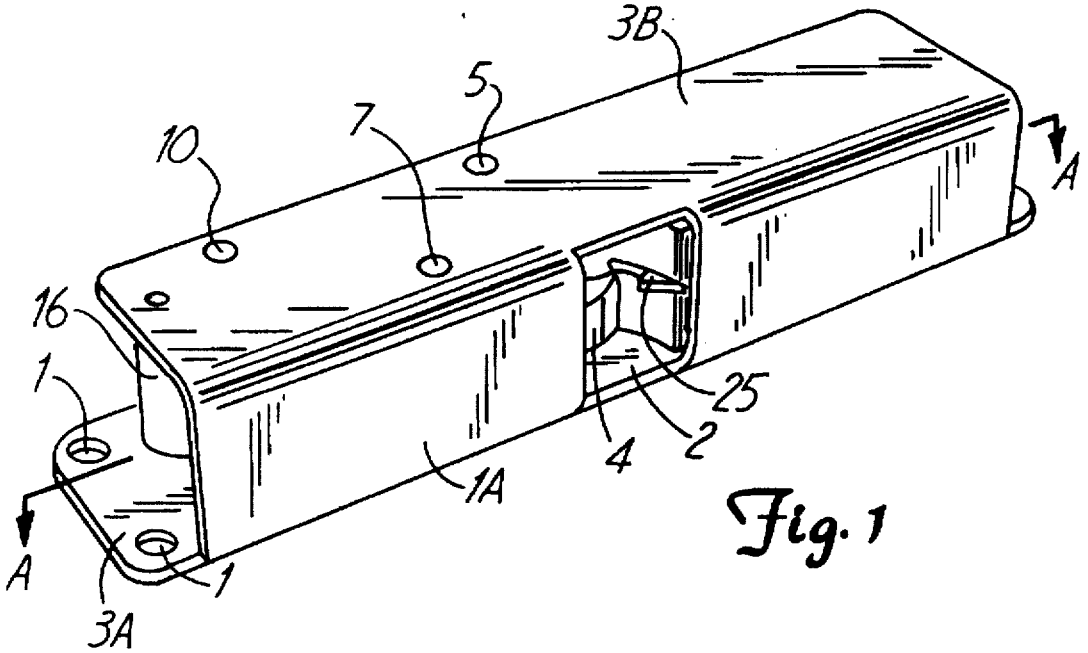
FIG. 1 is a perspective view of the exterior of the lock.
Figure 4:
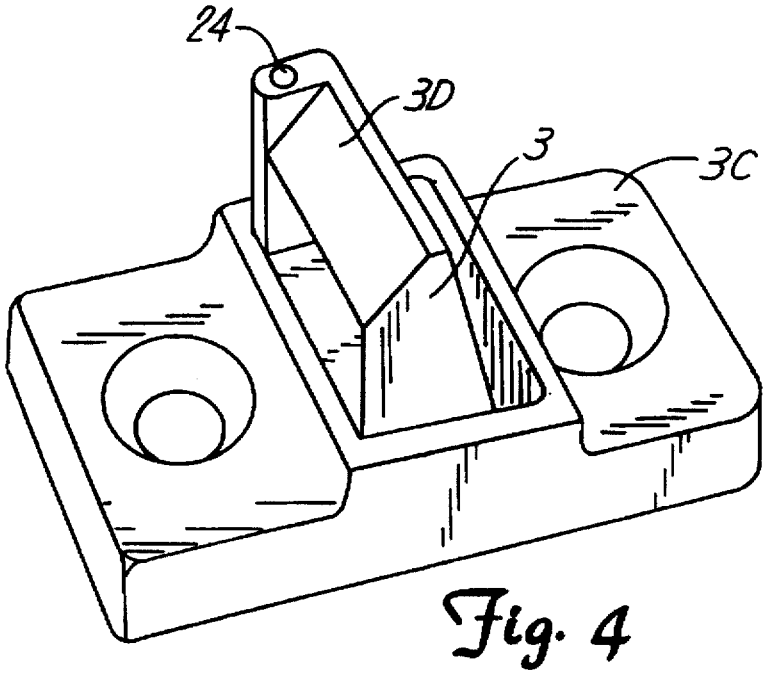
FIG. 4 is a perspective view of the striker.

Preferably indicators such as micro switches, magnetic sensing means or the like may also be fitted to the lock to show when the striker 3 and pawl 6 are in the locking positions shown in FIG. 2. With this embodiment a microswitch 20 may be located on a terminal block 21 within the housing such that said switch is closed by engaging a lug 22 on the pawl 6 as said pawl moves from the locking to the release positions. A magnetic sensing switch 23 may also be mounted adjacent the innermost tip of the striker 3 when it is in the locking position shown in FIG. 1. This would sense the close proximity of a magnetic insert 24 in the tip of the striker and thus indicate whether the door is in the closed position. The switches 20 and 23 may be wired to any suitable circuit for connection to a remote indicating means.

To enable striker 3 to more easily engage the tongue when closing the door its tip 3D may be bevelled and it is preferably hinged to its base 3C so that it can deflect slightly to the right as shown in FIGS. 2 and 3. Although not shown a spring would be incorporated into the base to return the striker to the left after it passes around the tongue 4 and into the lock housing.

A dead latch 25 is also preferably incorporated into the lock opposite the tongue. Its function is to prevent picking of the lock by the insertion of a tool to manually deflect the striker tip to the right to clear the tongue. The latch is spring loaded so that after initially deflecting to the right on insertion of the striker into the lock it again returns to the position shown. It also assists in holding the striker in the locked position in installations where the lock and striker are not alligned properly.

For the purposes of this specification expressions such as "upper", "lower", "front", "left" and "right" etc. refer to the lock in the position illustrated in the drawings and are not to be read as necessarily limiting It will thus be appreciated that this invention at least in the form of the embodiment disclosed provides a novel and unique improvement in electromechanical locks. Clearly however the embodiment described is only the currently preferred form of this invention and a wide variety of modifications may be made which would be apparent to a person skilled in the art. For example the shape of the various components of the lock as well as the offset angle of the toggles in the fail safe mode may all be modified without departing from the scope of this invention invention. The invention is also not limited to the use of any specific material for constructing the lock although steel is preferred.

What is claimed is:

1. A lock for a movable barrier such as a door, said lock comprising a tongue pivotable on a first axis between a locking position where it engages a striker and an unlocked position where it is clear of said striker, a pawl pivotable on a second axis between a first position where one end thereof abuts said tongue to hold it in said locking position and a second position where said one end is clear of the tongue and a set of toggles hingedly connected end to end between another opposite end of said pawl and a third axis, the interconnected ends of said toggles being connected to a solenoid plunger by a linkage and a stop means movable between a fail secure position where, when said solenoid is deactivated said toggles are biased by a spring means against said stop means in a substantially straight configuration to hold the pawl and tongue in said locking position, and a fail safe position where during energization of said solenoid said toggles are held to a slightly offset position against said stop means and upon deactivation of said solenoid said spring means urges said toggles to a folded configuration and said pawl and tongue means are arranged to then pivot to said unlocked position upon a withdrawal force being applied to the striker.

2. The lock as claimed in claim 1 wherein said solenoid is relocatable between two different locations corresponding to said fail secure and fail safe positions of said stop means.

3. The lock as claimed in claim 2 wherein said two different locations are along the line of an axis of said plunger axis.

4. The lock as claimed in claim 3 wherein the release of the striker when said stop means is in the fail safe position and the solenoid is deactivated is facilitated by the shape of said pawl which places a line of force acting on the pawl from the tongue along a direction slightly offset from said second axis.

5. The lock as claimed in claim 4 wherein when said stop means is in the fail safe position and the solenoid is energized said toggles are aligned at an angle of about 10 degrees off straight.

6. The lock as claimed in claim 5 wherein the toggles include a lug means which engage against said stop means.

7. The lock as claimed in claim 6 wherein said linkage extends between the interconnected ends of the toggles and said solenoid plunger, said link being adapted for limited axial sliding movement with respect to said plunger and a coiled compression spring which acts to bias said link away from the solenoid.

8. The lock as claimed in claim 7 and further including a housing which comprises an elongated three sided frame having a front face and upper and lower walls, said stop means and first, second and third axes being located between respective sets of aligned apertures in the upper and lower walls of said housing.

9. The lock as claimed in claim 8 wherein said lock includes a reed switch which is closed when engaged by a lug on said pawl as said pawl moves from the locking to the unlocking position.

10. The lock as claimed in claim 4 wherein said lock further includes a magnetic sensing switch which senses a magnetic insert in the striker when said striker is in the lock to thereby indicate when the door is closed.

* * * * *